United States Patent [19]

Schneider et al.

[11] Patent Number: 5,018,247

[45] Date of Patent: May 28, 1991

[54] CLEANING MACHINE FOR TEXTILE FIBRES WITH DRUM HAVING REDUCED DIAMETER OVER THE LENGTH

[75] Inventors: Ulf Schneider, Winterthur; René Schmid, Niederneunforn, both of Switzerland

[73] Assignee: Maschinenfabrik Rieter AG, Winterthur, Switzerland

[21] Appl. No.: 472,796

[22] Filed: Jan. 31, 1990

[30] Foreign Application Priority Data

Jan. 31, 1989 [CH] Switzerland ..... 320/89

[51] Int. Cl.[5] ..... D01G 9/20

[52] U.S. Cl. ..... 19/205; 19/97

[58] Field of Search ..... 19/97, 205

[56] References Cited

U.S. PATENT DOCUMENTS

| | | | |
|---|---|---|---|
| 788,812 | 5/1905 | Appleby | 19/97 |
| 1,459,938 | 6/1923 | Thiel | 19/90 |
| 2,411,575 | 11/1946 | Kay | 19/97 |
| 3,968,542 | 7/1976 | Hollingsworth | 19/97 |
| 4,625,368 | 12/1986 | Leifeld | 19/205 |

FOREIGN PATENT DOCUMENTS

| | | | |
|---|---|---|---|
| 250077 | 12/1910 | Fed. Rep. of Germany | 19/97 |
| 508356 | 9/1930 | Fed. Rep. of Germany . | |
| 162667 | 11/1922 | United Kingdom . | |
| 1009284 | 11/1965 | United Kingdom . | |

*Primary Examiner*—Werner H. Schroeder
*Assistant Examiner*—John J. Calvert
*Attorney, Agent, or Firm*—Burns, Doane, Swecker & Mathis

[57] ABSTRACT

A machine for cleaning textile fibres including a casing, a horizontal opening roller rotatably mounded in the casing, the roller body having a roller body and beater rods protruding from the peripheral area of the roller body and bar grates arranged below the underside of the opening roller. Textile fibres in the form of flocks are conveyed in a delivery air stream through an inlet which is arranged at a first end of the opening roller. An outlet for egress of the delivery air stream is arranged at the other end of the opening roller. In one arrangement, the radial length of the beater rods decreases from the inlet to the outlet and the diameter of the roller body increases from the inlet to the outlet. This arrangement allows the opening of the fibre flocks to be improved and permits a more complete separation of impurities through the bar grates.

30 Claims, 2 Drawing Sheets

Fig. 5
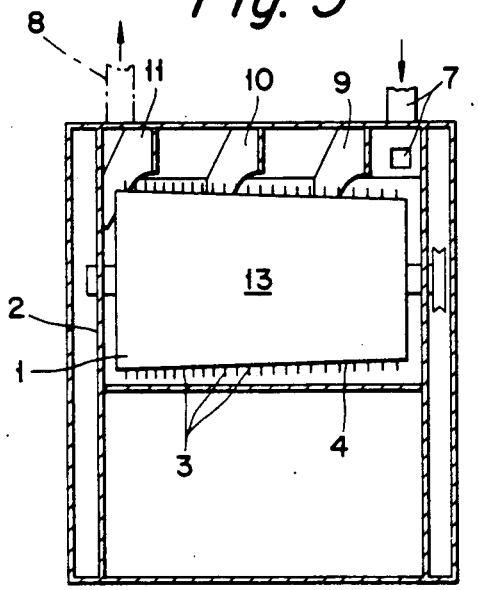
Fig. 7
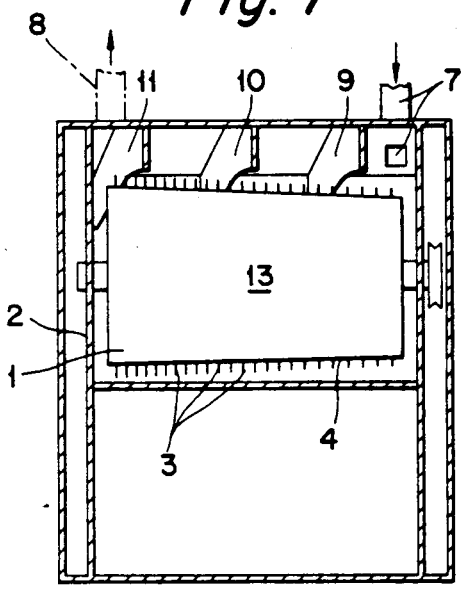
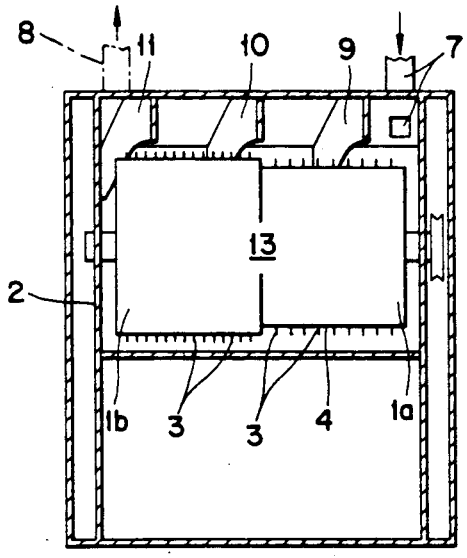
Fig. 6
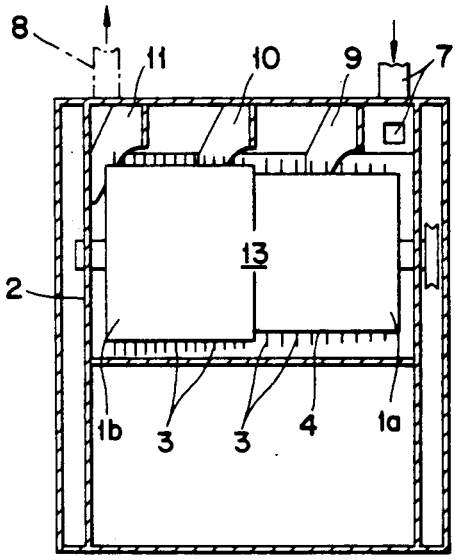
Fig. 8

CLEANING MACHINE FOR TEXTILE FIBRES WITH DRUM HAVING REDUCED DIAMETER OVER THE LENGTH

FIELD OF THE INVENTION

The invention relates to a cleaning machine for textile fibres transported in a stream of delivery air, the machine including a horizontal opening roller which has a roller body and beater rods protruding from the peripheral area of the roller body, with bar grates arranged below the underside of the opening roller and also with an inlet and an outlet for the delivery air, which are arranged, respectively, at first and second ends of the opening roller.

BACKGROUND

At least one cleaning machine of the above type is known and available on the market. It serves the purpose of opening the fibres conveyed in the delivery air and removing the impurities therein. The fibre material is pulled over the bar grates, whereby impurities penetrate through the bar grates and are then sucked up.

At present, it is known that bale opening machines, for example, those sold by the assignee of the present invention on a world wide basis under the name of UNIFLOC, deliver a relatively even flock stream to the following delivery air stream which, however, can again result in small accumulations of fibre flocks in the course of the pneumatic transport. The fibre flocks should be reopened by the cleaning machine according to the invention before the flocks delivered by the bale opening machine can be processed.

SUMMARY OF THE INVENTION

An object of the invention is to provide a cleaning machine of the above type wherein an improved opening effect results, from one end to the other end of the opening roller, whereby an improved separation of the impurities can be achieved, when compared with the known machine.

The above object can be achieved according to the invention by providing an opening roller in which the diameter of the roller body increases from one end to the other of the opening roller.

In accordance with the present invention, it is possible during transport of the fibre flocks in the delivery air from one end to the other end of the opening roller, for the fibre flocks to be progressively opened through the effect of the cleaning machine. According to another feature of the present invention, the length of the beater rods can be variable along the length of the roller from one end to the other, the length of the beater rods being variable and adjusted to suit the material to be processed, depending on the progressive degree of opening of the fibre flock whereby a desired improvement in efficiency results.

BRIEF DESCRIPTION OF THE DRAWINGS

Examples of constructions of the cleaning machine according to the invention are explained in more detail in the following description with reference to the accompanying drawings, in which:

FIGS. 5–8 show various forms of constructions of the cleaning machine according to the invention.

DETAILED DESCRIPTION OF THE PREFERRED EMBODIMENTS

Figure 1:
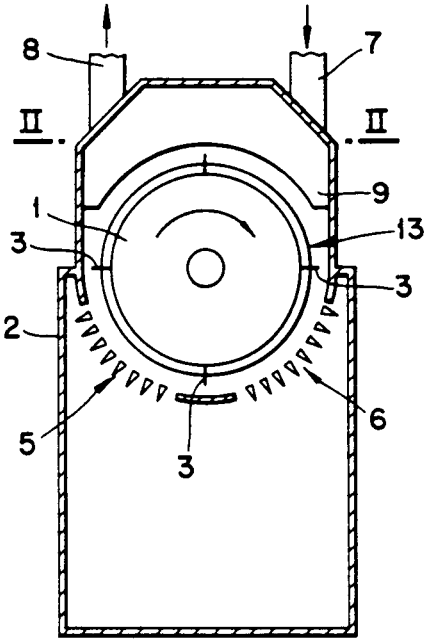
FIG. 1 shows a schematic vertical section through a cleaning machine according to one embodiment of the present invention.
Figure 3:
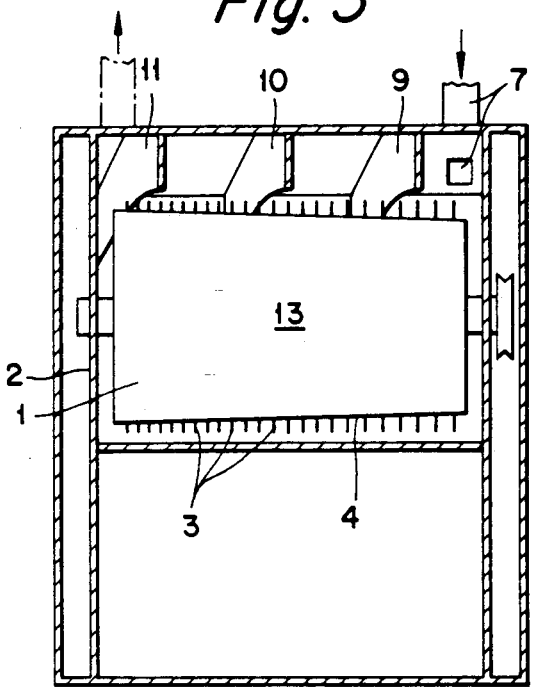
FIG. 3 shows a vertical side sectional view through the machine shown in FIG. 1.
Figure 2:
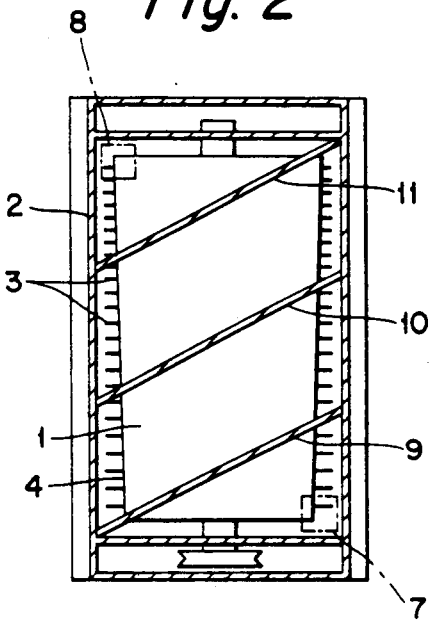
FIG. 2 shows a sectional topview of the machine shown in FIG. 1 taken along the line II—II in FIG. 1.

The cleaning machine shown in FIGS. 1-3 has an opening roller 13 with a roller body 1, which is supported for rotation on a horizontal axis in a casing 2. The roller body 1 is fitted with beater rods 3 which protrude radially outwardly from the continuous non-perforated peripheral area 4 of the roller body 1. The opening roller 13 is driven in the direction of the arrow shown in FIG. 1 by a driving motor, not shown. Below the underside of the opening roller 13, there are two bar grates 5 and 6, which are only shown in FIG. 1. Above the upper side of the opening roller 13, the casing 2 has an air inlet 7 at the first end of the roller which is on the right in FIGS. 1 and 3 and at the lower right corner in FIG. 2, respectively, and an air outlet 8 at the other end of the roller, shown at the left in FIGS. 1 and 3 and at the upper left corner in FIG. 2, respectively. In FIG. 2, the locations of the inlet 7 and the outlet 8 and in FIGS. 3 and 4, the positions of the outlet 8, which are hidden from view, are each indicated with a dash-dotted line. Three deflectors 9, 10 and 11, inclined to the axis of the roller are arranged over the upper side of the opening roller 13 between the inlet 7 and the outlet 8, the deflectors defining two transfer chambers between the upper side of the roller 13 and the upper wall of the casing 2.

In operation, textile fibre flocks to be cleaned and opened are conveyed to the machine in a delivery air stream through the inlet 7 of the cleaning machine. The delivery air with the fibre flocks streams mainly around the underside of the rotating opening roller 13, then through the transfer chamber between the deflectors 9 and 10, which moves the air further in the direction of the axis of the opening roller, then again around the underside of the roller, then through the transfer chamber between the deflectors 10 and 11 and again around the underside of the roller, in order to leave the machine finally through the outlet 8. With the circulation on the underside of the roller, the fibre flocks are progressively opened through the beater rods 3 and guided past the grate bars 5 and 6 during a stroking and beating process, so that impurities are separated from the fibres through the grates 5 and 6 and sucked out from the space under the bar grates through a suction device, not shown.

The process described above is improved in the machine according to the invention, by the fact that the diameter of the roller body 1 increases from the inlet 7 to the outlet 8. Thereby, according to FIGS. 2–4, the measured radial length of the beater rods 3 as measured from the peripheral area 4 of the roller can decrease from the inlet 7 to the outlet 8 from one end to the opening roller to the other, as shown. For example, the radial length of the beater rods 3 at the outlet can amount to 25 to 75%, preferably about 50%, of the radial length of the beater rods at the inlet. However, it is possible in accordance with the invention for some of the beater rods 3, for example, to also have a reduced length at the inlet.

The free ends of the beater rods 3 can at least lie approximately in an imaginary coaxial circular cylindrical area near to the roller body 1. Accordingly, the free ends of the beater rods 3 can be located approximately the same distance from the axis of the roller body 1. It should be noted, however, that some of the beater rods 3 of a particular group of beater rods can be shorter, so that their free ends are located at a smaller distance from the axis of the roller body 1 than other beater rods of the group.

The roller body shown in FIGS. 1 to 3 is conical, so that its diameter gradually increases from the inlet 7 to the outlet 8. In the same way, the radial length of the beater rods 3 gradually decreases from the inlet 7 to the outlet 8. The length of the beater rods 3 can also decrease in steps, for example, in one group, the beater rods can all have the same length and in another group, the beater rods can be somewhat shorter and so on.

Figure 4:
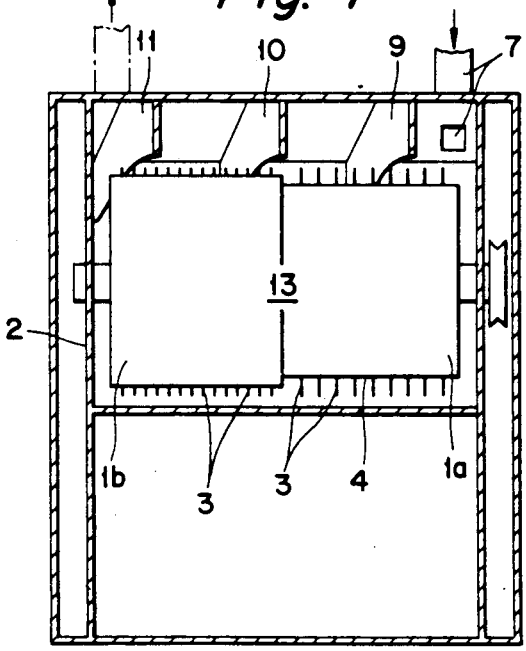
FIG. 4 shows a vertical side sectional view similar to that shown in FIG. 3, but of a cleaning machine according to another embodiment of the invention.

The diameter of the roller body can also decrease in steps from the inlet 7 to the outlet 8. In FIG. 4, in which the same parts have the same reference symbols as in FIG. 3, a different embodiment of the invention is shown wherein a roller body comprises two cylindrical sections 1*a* and 1*b*. The section 1*a*, at the inlet 7 on the right in FIG. 4, has a smaller diameter than the left hand section 1*b* in FIG. 4 and the beater rods 3 arranged in the section 1*b* have a smaller radial length than the beater rods 3 arranged in the section 1*a*, again in the way that the free ends of the beater rods 3 at least lie approximately in a circular cylindrical area which is coaxial with the roller body 1*a*, 1*b*. In a modified arrangement, the sections 1*a* and/or 1*b* can additionally be slightly conical. The roller bodies can also comprise more than two sections with increasing diameters from the inlet to the outlet.

The fibre flocks with the delivery air which are conveyed through the inlet 7 to the cleaning machine described above are progressively opened on the way to the outlet 8. The beater rods 3 can be adapted to the progressive degree of opening through their decreasing lengths from the inlet 7 to the outlet 8. In addition, with the progressive degree of opening of the fibre flocks, the amount per area of the beater rods can also be increased with advantage. Accordingly, the axial clearance between neighboring beater rods 3 can be smaller at the outlet 8 than at the inlet 7, for instance, about in the relationship of 2:3 as shown.

At the same time, the thickness of the beater rods 3 (measured in a direction perpendicular to the length thereof extending between the peripheral area of the roller body and free ends of the beater rods) as seen from the inlet 7 to the outlet 8 in the direction of the axis of the roller body 1 or 1*a*, 1*b*, can decrease so that the beater rods 3 are thinner at the outlet 8 than at the entry 7. For instance, the thickness of the beater rods at the outlet 8 compared to the inlet 7 can likewise be in the relationship of 2:3. This thickness is equal to the diameter of the beater rods 3 when they are round. The beater rods 3, however, can also have a different shape, for example, with cross sections which are square, rectangular, etc. Instead of the foregoing beater rods, other beater rods can also be used, e.g. small plate shaped rods from steel sheet.

In a practical example according to the invention, an opening roller 13 can have the following dimensions:

Length of the roller body 1: about 1.6 m;

Diameter of the roller body 1: at the inlet 7 about 65 cm and at the outlet 8 about 70 cm;

Radial length of the beater rods 3: at the inlet 7 about 5 cm and at the outlet 8 about 2.5 cm;

Diameter of the beater rods 3: about 1 cm (possibly diminishing from the inlet 7 to the outlet 8 from 1.2 to 0.8 cm);

Axial clearance between neighbouring beater rods: about 2.5 cm (possibly diminishing from the inlet 7 to the outlet 8 from 3 to 2 cm).

Other embodiments of the invention are shown in FIGS. 5 and 6 which relate to the length of the beater rods 3. For example, in these two embodiments, the beater rods can have the same length over the entire length of the roller body, e.g. 3.5 cm. With this arrangement, the opening effect of the so-called agglomerations of fibre flocks at the start of the processing is somewhat reduced, that is, it is a little less aggressive than in the embodiment according to FIGS. 2–4. This is essentially desirable, especially when cotton with longer fibres is processed, in order to avoid as far as possible the risk of the formation of neps with the opening of the accumulations, the term "neps" referring to small knotting of fibres. In these embodiments, the roller shown in FIG. 5 is tapered such that it increases in diameter toward an outlet end of the roller and the roller shown in FIG. 6 is stepped with a portion at the inlet end thereof having a smaller diameter than a portion at an outlet end thereof.

A still more consistent reduction of the aggressiveness of the beater rods 3 at the start of the process is shown in the embodiments according to FIGS. 7 and 8, wherein the length of the beater rods 3 increases from the start of the processing to the end, that is, the rods are shorter in length at the inlet end of the roller and longer at that the outlet end of the roller.

This increase can be 25%–100%, for example. With an increase of 100%, the length of the beater rods at the start of the processing (inlet end of the roller) can amount to 2.5 cm and at the end of the processing (outlet end of the roller) 5 cm. In these embodiments, the roller shown in FIG. 7 is tapered such that it increases in diameter towards an outlet end thereof and the roller shown in FIG. 8 is stepped with a portion at the inlet end thereof having a smaller diameter than a portion at an outlet end thereof.

With the aid of the increasing beater rod length, it can be achieved that, after the agglomerations have been opened, the fibre flocks with the longer fibres can be opened more intensively than with shorter beater rods at the end of the process.

Accordingly, the modifications to the thickness or type of beater rods as already explained can be applied for the embodiments of FIGS. 5 and 6 as well as 7 and 8. The same also applies to the variable thickness of the beater rods on the roller body.

In accordance with the teachings of the present invention, the dimensions of the beater rods can be varied, if desired, along the length of the roller body to suit particular processing objectives. For instance, the length of at least some of the beater rods can increase monotonically or in a step-like fashion from one end to an opposite end of the roller body. In particular, the length of the beater rods can increase 25 to 100% at positions between opposite ends of the roller body.

While the present invention has been described with reference to the foregoing embodiments, variations and modifications may be made thereto which fall within the scope of the appended claims.

What is claimed is:

1. A cleaning machine for textile fibres transported in a delivery air stream, the machine comprising a casing, a horizontal opening roller rotatably supported in the casing, the roller including a roller body and beater rods protruding from a peripheral area of the roller body, grate bars arranged below an underside of the opening roller and an inlet and an outlet for conveying a delivery air stream to and from the opening roller, the inlet and the outlet being arranged at first and second ends, respectively, of the opening roller, the machine further including at least one deflector inclined to an axis of rotation of the opening roller such that the delivery air stream flows around and along the opening roller, the roller body having a diameter which increases from the first end to the second end of the opening roller, the peripheral area of the roller body comprising a continuous surface extending circumferentially around a rotation axis of the roller body.

2. The cleaning machine according to claim 1, wherein the roller body is conical.

3. The cleaning machine according to claim 1, wherein the diameter of the roller body increases in steps.

4. The cleaning machine according to claim 3, wherein at least one of the steps is conical.

5. The cleaning machine according to claim 1, wherein a length of at least some of the heater rods measured from the peripheral area of the roller body from the first to the second end of the opening roller remains substantially the same.

6. The cleaning machine according to claim 1, wherein the casing has inner walls facing the peripheral area of the roller body, the inner walls being substantially parallel to the rotation axis of the roller body.

7. A cleaning machine for textile fibres transported in a delivery air stream, the machine comprising a casing, a horizontal opening roller rotatably supported in the casing, the roller including a roller body and beater rods protruding from a peripheral area of the roller body, grate bars arranged below an underside of the opening roller and an inlet and an outlet for conveying a delivery air stream to and from the opening roller, the inlet and the outlet being arranged at first and second ends, respectively, of the opening roller, the roller body having a diameter which increases from the fist end to the second end of the opening roller, a length of at least some of the beater rods measured from the peripheral area of the roller body decreasing from the first end to the second end of the opening roller.

8. The cleaning machine according to claim 7, wherein the length of the beater rods at the second end of the opening roller amounts to 25 to 75% of the length of the beater rods at the first end of the opening roller.

9. The cleaning machine according to claim 8, wherein the length of the beater rods at the second end of the opening roller is approximately 50% of the length of the beater rods at the first end of the opening roller.

10. The cleaning machine according to claim 7, wherein free ends of the beater rods lie at least approximately in a circular cylindrical area which is coaxial with the roller body.

11. A cleaning machine for textile fibres transported in a delivery air stream, the machine comprising a casing, a horizontal opening roller rotatably supported in the casing, the roller including a roller body and beater rods protruding from a peripheral area of the roller body, grate bars arranged below an underside of the opening roller and an inlet and an outlet for conveying a delivery air stream to and from the opening roller, the inlet and the outlet being arranged at first and second ends, respectively, of the opening roller, the roller body having a diameter which increases from the first end to the second end of the opening roller, a length of at least some of the beater rods measured from the peripheral area of the roller body increasing monotonically from one end to an opposite end of the opening roller.

12. The cleaning machine according to claim 11, wherein the length of the beater rods measured from the peripheral area of the roller body increases from 25% to 100%.

13. A cleaning machine for textile fibres transported in a delivery air stream, the machine comprising a casing, a horizontal opening roller rotatably supported in the casing, the roller including a roller body and beater rods protruding from a peripheral area of the roller body, grate bars arranged below an underside of the opening roller and an inlet and an outlet for conveying a delivery air stream to and from the opening roller, the inlet and the outlet being arranged at first and second ends, respectively, of the opening roller, the machine further including at least one deflector inclined to an axis of rotation of the opening roller such that the delivery air stream flows around and along the opening roller, the roller body having a diameter which increases from the first end to the second end of the opening roller, a clearance between adjacent beater rods along a direction parallel to an axis of rotation of the opening roller decreasing from the first end to the second end of the opening roller, the peripheral area of the roller body comprising a surface extending circumferentially around said rotation axis of the roller body.

14. A cleaning machine for textile fibres transported in a delivery air stream, the machine comprising a casing, a horizontal opening roller rotatably supported in the casing, the roller including a roller body and beater rods protruding from a peripheral area of the roller body, grate bars arranged below an underside of the opening roller and an inlet and an outlet for conveying a delivery air stream to and from the opening roller, the inlet and the outlet being arranged at first and second ends, respectively, of the opening roller, the roller body having a diameter which increases from the first end to the second end of the opening roller, a thickness of at least some of the beater rods measured in a direction perpendicular to a length thereof between the peripheral area of the roller body and free ends of the beater rods decreasing from the first end to the second end of the opening roller.

15. An opening roller for a cleaning machine useful for cleaning textile fibres, the opening roller comprising a roller body and beater rods extending radially outwardly from an outer periphery of the roller body, the beater rods being located at axially spaced-apart positions and at circumferentially spaced-apart positions around the roller body, the roller body having a diameter which increases along an axial length of the roller body between a first end of the roller body and a second end of the roller body, the outer periphery of the roller body comprising a continuous non-perforated surface extending circumferentially around a rotation axis of the roller body.

16. The cleaning machine according to claim 15, wherein the roller body is tapered along the axial length thereof.

17. The cleaning machine according to claim 15, wherein the roller body includes at least one step in the outer periphery thereof along the axial length thereof.

18. The cleaning machine according to claim 15, wherein free ends of the beater rods lie substantially on a surface of an imaginary cylinder which is coaxial with an axis of rotation of the opening roller.

19. The cleaning machine according to claim 15, wherein the beater rods are round in cross-section.

20. An opening roller for a cleaning machine useful for cleaning textile fibres, the opening roller comprising a roller body and beater rods extending radially outwardly from an outer periphery of the roller body, the beater rods being located at axially spaced-apart positions and at circumferentially spaced-apart positions around the roller body, the roller body having a diameter which increases along an axial length of the roller body between a first end of the roller body and a second end of the roller body, at least some of the beater rods having dimensions which are different along the length of the roller body.

21. The cleaning machine according to claim 20, wherein a length of at least some of the beater rods between the outer periphery area of the roller body and free ends of the beater rods is shorter at the first end of the roller body then at the second end of the roller body.

22. The cleaning machine according to claim 21, wherein the diameter of the roller body is larger at the second end of the roller body than at the first end of the roller body.

23. The cleaning machine according to claim 21, wherein the diameter of the roller body is larger at the first end of the roller body than at the second end of the roller body.

24. The cleaning machine according to claim 20, wherein at least some of the beater rods have a thickness measured in a plane parallel to an axis of rotation of the opening roller which is larger at one position along the axial length of the roller body that at another position along the axial length of the roller body.

25. An opening roller for a cleaning machine useful for cleaning textile fibres, the opening roller comprising a roller body and beater rods extending radially outwardly from an outer periphery of the roller body, the beater rods being located at axially spaced-apart positions and at circumferentially spaced-apart positions around the roller body, the roller body having a diameter which increases along an axial length of the roller body between a first end of the roller body and a second end of the roller body, the roller body including a first portion having a diameter which is smaller than a diameter of a second portion of the roller body, at least some of the beater rods on the first portion having a length between the outer periphery of the roller body and free ends of the beater rods which is greater than a corresponding length of at least some of the beater rods on the second portion.

26. An opening roller for a cleaning machine useful for cleaning textile fibres, the opening roller comprising a roller body and beater rods extending radially outwardly from an outer periphery of the roller body, the beater rods being located at axially spaced-apart positions and at circumferentially spaced-apart positions around the roller body, the roller body having a diameter which increases along an axial length of the roller body between a first end of the roller body and a second end of the roller body, the roller body including a first portion having a diameter which is smaller than a diameter of a second portion of the roller body, at least some of the beater rods on the first portion having a length between the outer periphery of the roller body and free ends of the beater rods which is smaller than a corresponding length of at least some of the beater rods on the second portion.

27. An opening roller for a cleaning machine useful for cleaning textile fibres, the opening roller comprising a roller body and beater rods extending radially outwardly from an outer periphery of the roller body, the beater rods being located at axially spaced-apart positions and at circumferentially spaced-apart positions around the roller body, the roller body having a diameter which increases along an axial length of the roller body between a first end of the roller body and a second end of the roller body, the roller body being tapered along the axial length thereof, at least some of the beater rods having a length between the outer periphery of the roller body and free ends thereof which increases along the length of the roller body.

28. The cleaning machine according to claim 27, wherein the length of the beater rods increases at positions along the roller body at which the diameter of the roller body increases.

29. The cleaning machine according to claim 27, wherein the length of the beater rods decreases at positions along the roller body at which the diameter of the roller body increases.

30. An opening roller for a cleaning machine useful for cleaning textile fibres, the opening roller comprising a roller body and beater rods extending radially outwardly from an outer periphery of the roller body, the beater rods being located at axially spaced-apart positions and at circumferentially spaced-apart positions around the roller body, the roller body having a diameter which increases along an axial length of the roller body between a first end of the roller body and a second end of the roller body, at least some of the beater rods being located closer together at a first portion of the roller body than at a second portion of the roller body, the first portion being located closer to one axial end of the roller body than the second portion, the peripheral area of the roller body comprising a non-perforated surface extending circumferentially around a rotation axis of the roller body.

* * * * *